United States Patent [19]

Butterworth et al.

[11] Patent Number: 4,544,814

[45] Date of Patent: Oct. 1, 1985

[54] MECHANICAL INTERLOCK FOR CONTACTORS

[75] Inventors: Edmund M. Butterworth, Brown Deer; William G. Dennison, Cedarburg, both of Wis.

[73] Assignee: Eaton Corporation, Cleveland, Ohio

[21] Appl. No.: 572,032

[22] Filed: Jan. 19, 1984

[51] Int. Cl.[4] ..... H01H 9/26

[52] U.S. Cl. ..... 200/50 C

[58] Field of Search ..... 200/5 R, 5 B, 5 C, 5 E, 200/50 C; 335/132–135, 159–161, 120

[56] References Cited

U.S. PATENT DOCUMENTS

| | | | |
|---|---|---|---|
| 3,210,491 | 10/1965 | DiMarco | 200/50 C |
| 3,312,797 | 4/1967 | Harrington et al. | 200/50 C |
| 3,342,958 | 9/1967 | Arneberg | 200/50 C |
| 3,368,171 | 2/1968 | Conner et al. | 335/120 |
| 3,453,569 | 7/1969 | Ostby | 335/132 |
| 3,510,612 | 5/1970 | Ward | 200/50 C |
| 3,592,985 | 7/1971 | Arneberg | 200/50 C |
| 3,815,063 | 6/1974 | Grunert et al. | 335/160 |
| 3,824,510 | 7/1974 | Kolb et al. | 335/160 |
| 4,100,517 | 7/1978 | Rodolfi | 335/132 |
| 4,409,575 | 10/1983 | Hisadome | 335/160 |

*Primary Examiner*—J. R. Scott

*Attorney, Agent, or Firm*—C. H. Grace; Wm. A. Autio

[57] ABSTRACT

A mechanical interlock (6) for coupling a pair of contactors (2, 4) to prevent concurrent closure thereof. The interlock includes a generally T-shaped one-piece molded frame (16) having a pair of mounting hooks (16*a*, 16*b*) at one side at the ends of its arms for coupling to false-front upper corners (2*c*, 2*d*) of a first contactor (2) and another pair of mounting hooks (16*c*, 16*d*) at the other side at the ends of its arms for similarly coupling to the other contactor (4). Snap-in lugs (16*e*, 16*f*) snap into a rectangular aperture (2*b*) in the contactor wall to retain the interlock in place. A rockable, spring-biased interlock pawl (18) snap-in mounted within the frame has projecting wings (18*e*, 18*f*) that extend into the contactor aperture (2*b*) below a contact carrier projection (8*a*) so that downward actuation of the contact carrier of one contactor rocks the pawl so as to compress its bias, return spring (20) and cause a toe (18*d*) at the lower end of the pawl to slide down one side of a double-incline bump (16*k*) into a pocket at the bottom of the frame thereby preventing depression of the other wing of the pawl by the other contactor and prevent closure of the other contactor at the same time.

5 Claims, 9 Drawing Figures

MECHANICAL INTERLOCK FOR CONTACTORS

BACKGROUND OF THE INVENTION

Mechanical interlocks for contactors have been known heretofore. For example, A. F. Kolb and J. J. Gilmore U.S. Pat. No. 3,824,510, dated July 16, 1974, shows a thermoplastic interlock member that mechanically interlocks the operation of a pair of electrical relays. This interlock member is a compact one piece member comprising a frame, anchorage means for anchoring the frame between two relay assemblies, each relay assembly having a respective armature, and an interlock element, suspended within the frame by an integral flexible link for movement laterally of the frame, to prevent simultaneous actuation of the relay contacts. The interlock element has inclined surfaces extending laterally of the frame and into the paths of movement of the two armatures so that the interlock element is laterally displaced to obstruct the path of movement of one armature to prevent closure of the associated contacts whenever the other armature engages the inclined surface thereof.

While mechanical interlocks known in the prior art as represented by the interlock member of the aforementioned patent have been useful for their intended purposes, this invention relates to improvements thereover.

SUMMARY OF THE INVENTION

An object of the invention is to provide an improved mechanical interlock for contactors that prevents concurrent closure of the contacts thereof.

A more specific object of the invention is to provide a mechanical interlock for a pair of contactors that additionally provides a strong and rigid upper connection between the housings of the contactors.

Another specific object of the invention is to provide an improved mechanical interlock for contactors that requires minimum contactor operating motion to perform the interlocking function.

Another specific object of the invention is to provide a mechanical interlock for contactors that is subjected to minimum wear in operation and thus will last through a large number of operations of the order of ten million or the like.

Another specific object of the invention is to provide a mechanical interlock for contactors that is easy to assemble onto the contactors and holds them firmly together.

Another specific object of the invention is to provide a mechanical interlock for contactors with improved means that essentially eliminates lost motion between the contact operating mechanisms of the contactors and the interlock.

Another specific object of the invention is to provide a mechanical interlock for contactors with improved means that provides positive interlocking stop action without significant wear over a large number of operations.

Another specific object of the invention is to provide a mechanical interlock for contactors that is simple and economical in construction consistent with a long useful life.

Other objects and advantages of the invention will hereinafter appear.

DESCRIPTION OF THE PREFERRED EMBODIMENT

Figure 1:
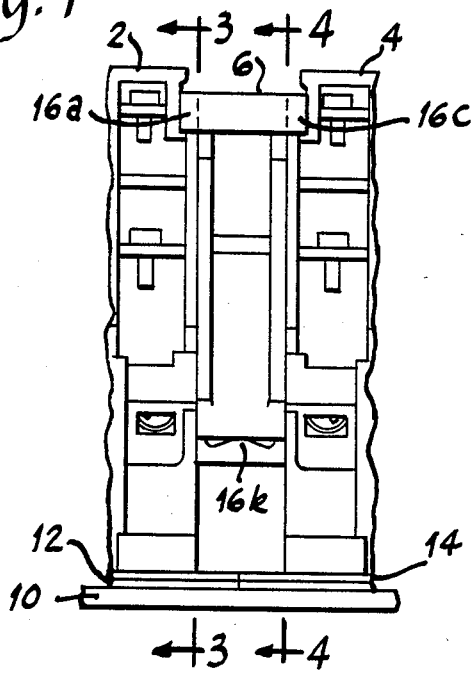
FIG. 1 is a partial front elevational view of a pair of contactors with the mechanical interlock mounted therebetween.
Figure 2:
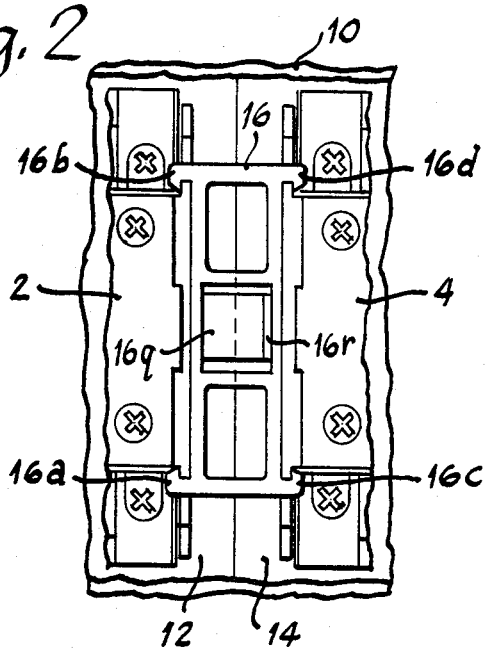
FIG. 2 is a partial top view of the pair of contactors and mechanical interlock of FIG. 1.

Referring to FIGS. 1 and 2, there is shown a mechanical interlock coupled between a pair of contactors according to the invention. The purpose of the interlock is to prevent simultaneous actuation of the switch actuating members of both of the contactors in a pair of adjacently mounted contactors thereby to prevent concurrent closure of the contacts. A typical usage of contactors of this type is to connect motor windings of a reversible motor across the power lines and, consequently, means must be provided to prevent simultaneous closing of the two contactors and thereby prevent energization of the motor in both the forward and reverse direction at the same time. For this reason, it is necessary that such contactors be positively interlocked to prevent the closing of a circuit through more than one of the contactors at any given instant.

Figure 3:
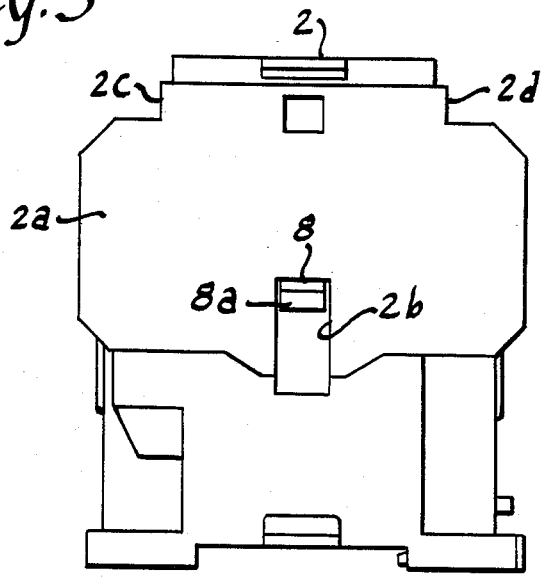
FIG. 3 is a side view of one of the contactors taken substantially along line 3—3 of FIG. 1, showing the aperture and switch actuating member therein.

Referring to FIGS. 1 and 2, there is shown a fragmentary portion of each of a pair of contactors 2 and 4 with a mechanical interlock 6 coupled therebetween. As shown in FIG. 3, each of the contactors of FIG. 1 such as contactor 2, for example, has a generally flat wall 2*a* including a rectangular aperture 2*b* substantially centrally thereof. This aperture provides access for the pawl of the mechanical interlock into the interior contact operating mechanism of the contactor.

As will be apparent, a contactor is an electromagnetic switching device having an insulating housing within which is endlosed an electromagnet and contacts, The stationary contacts are normally mounted on the housing and the movable contacts are normally mounted on a switch actuating member such as an insulating contact carrier 8. As shown in FIG. 3, the contact carrier or switch actuating member 8 is partially visible through aperture 2*b* and is provided with a generally rectangular projection 8*a* the outer end of which is substantially flush with the side surface of the flat wall 2*a* of the contactor and which engages the mechanical interlock 6 as hereinafter more fully described.

As shown in FIGS. 1 and 2, contactors 2 and 4 are mounted in spaced side by side relation on a mounting panel 10 or other supporting means such as a snap in rail or the like. For securing the two contactors onto the mounting panel, for example, the contactors are provided with base plates 12 and 14 made of steel, plastic or the like. These base plates may be rigidly secured to the bottom surfaces of the insulating housings of the contactors in any one of a number of different ways, for example, a snap-in means having hooks and a spring-biased catch, screws or the like. The base plate is then attached by screws or the like to mounting panel 10.

Contactors 2 and 4 and mechanical interlock 6 are provided with means for snap-in mounting the mechanical interlock onto and between the two contactors to rigidly fix them and maintain them in spaced apart relation as shown in FIGS. 1 and 2. For this purpose, each contactor is provided at the upper portion of each of its sidewalls such as sidewall 2*a* shown in FIG. 3 with a pair of "false-front" upper left and right corners 2*c* and 2*d*. Each of these corners 2*c* and 2*d* has a vertical outer edge and a thickness which is complementary to the mounting hooks on the frame 16 of mechanical interlock 6 hereinafter described.

Figure 4:
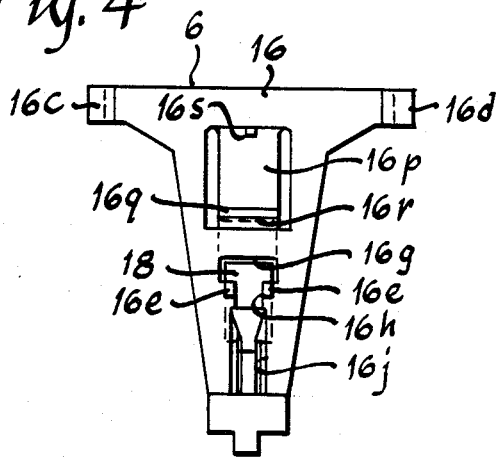
FIG. 4 is a side view of the mechanical interlock of FIG. 1 taken substantially along line 4—4 of FIG. 3.
Figure 6:
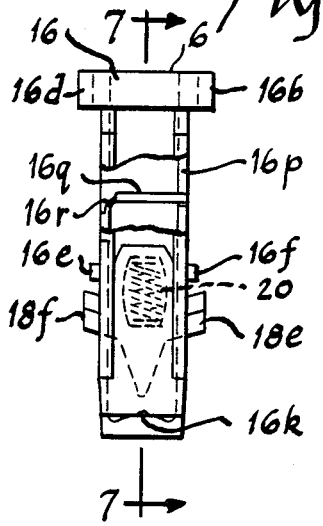
FIG. 6 is a right end view of the mechanical interlock of FIGS. 4 and 5.
Figure 5:
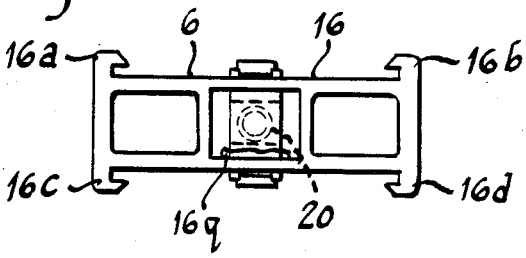
FIG. 5 is a top view of the mechanical interlock of FIG. 4 with the cover-panel broken away to show the pawl therebelow.

As shown in FIGS. 4–6, frame 16 of the mechanical interlock 6 is a generally T-shaped molded member having a first pair of hooks 16*a* and 16*b* on one side at the ends of its arms for hooking onto corners 2*c* and 2*d* of a first contactor 2 and a second pair of hooks 16*c* and 16*d* for hooking onto similar upper corners of contactor 4 as shown in FIG. 2. To complete the snap-in means, frame 16 of the mechanical interlock has lug means such as a pair of lugs 16*e* on one side and another like pair of lugs 16*f* on the other side as shown in FIGS. 4 and 6. To assemble the mechanical interlock frame onto a contactor, the mechanical interlock is placed against flat wall 2*a* of the contactor such that hooks 16*a* and 16*b* are above corners 2*c* and 2*d* and the mechanical interlock is then slid downwards. As a result corners 2*c* and 2*d* enter into hooks 16*a* and 16*b* and as the hooks slide down along these corners, these hooks are stressed a certain amount because lugs 16*f* abut the wall of the contactor above aperture 2*b* so that the mechanical interlock is at a slight angle with respect to the wall of the contactor. As the hooks 16*a* and 16*b* reach the lower ends of the vertical edges of corners 2*c* and 2*d*, lugs 16*f* snap into the upper corners of aperture 2*b*, relieving the stress on the hooks previously mentioned. As a result, the hooks 16*a* and 16*b* will hold the mechanical interlock frame 16 tightly against wall 2*a* of the contactor. At the same time one wing 18*e* of the pawl 18, hereinafter described, snaps below projection 8*a* of the contact carrier so that when the contact carrier is therafter actuated downwardly as seen in FIG. 3, the pawl is rocked into interlocking position as hereinafter more fully described and shown in FIG. 9.

In a similar manner the mechanical interlock frame 16 is coupled to the other contactor 4. For this purpose, hooks 16*c* and 16*d* are slid down similar corners of contactor 4, wing 18*f* of pawl 18 snaps below projection 8*a'* and lugs 16*e* snap into the aperture in the flat wall of that contactor.

Figure 7:
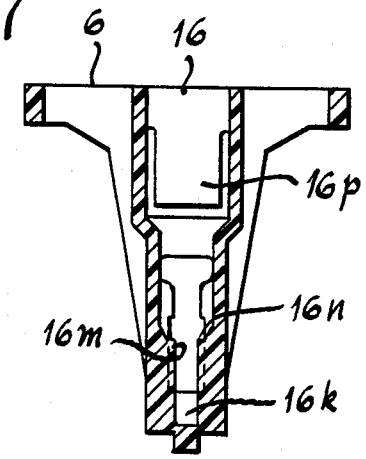
FIG. 7 is a cross-sectional view, with the pawl and its bias spring removed, of the mechanical interlock frame taken substantially along line 7—7 of FIG. 6.
Figure 8:
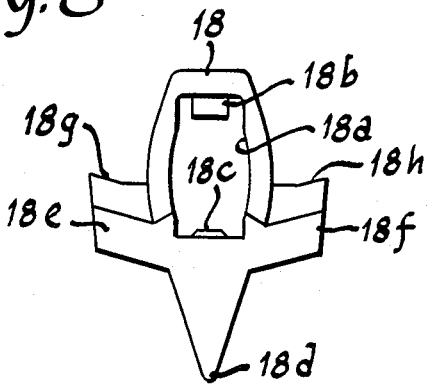
FIG. 8 is a front elevational view of the pawl used in the mechanical interlock of FIGS. 4–6.

As shown in FIGS. 6 and 8, the mechanical interlock also has a pawl 18 having an helical compression spring 20 mounted thereon. For this purpose, pawl 18 made of molded plastic has a generally vertically elongated or rectangular hole 18*a* therethrough as shown in FIG. 8 with an integrally molded lug 18*b* at the top of this hole and an integrally molded lug 18*c* at the bottom of this hole which enter into the upper and lower ends of compression spring 20 to retain it in place as shown in FIG. 6. This pawl 18 as shown in FIG. 8 is also provided with a tapered or pointed toe 18*d* at its lower end and a pair of wings 18*e* and 18*f* extending in opposite lateral directions. Wings 18*e* and 18*f* have upper surfaces 18*g* and 18*h* as shown in FIG. 8 that extend not only outwardly in opposite directions but also at a predetermined small angle upwardly so that when lug 8*a* of the contact carrier presses down thereon and rocks the pawl, the pawl will remain in solid contact with the contact carrier throughout its stroke of operation. Frame 16 has a hole in its right-hand side as seen in FIG. 6 large enough for insertion of pawl 18 therewithin. Frame 16 also has a relatively smaller opening 16*g* in its other side as shown in FIG. 4 through which a wing 18*f* of pawl 18 extends when the pawl is first inserted within the frame. As also shown in FIG. 4, a snap-down slot 16*h* of slightly narrower width than the wing of the pawl extends down from opening 16*g* and then continues into a wider opening 16*j* in which the wing of pawl 18 can freely move up and down. In a similar manner, the larger opening on the right-hand side of frame 16 as viewed in FIG. 6 has a snap-down slot like slot 16*h* which then continues into a similar slightly wider opening similar to opening 16*j* for allowing free vertical movement of the other wing of pawl 18. From the above it will be apparent that when pawl 18 is inserted into frame 16 it is then forced down so that the wings of the pawl snap down through snap-down slot 16*h* and a similar snap-down slot on the other side down into openings 16*j* and a similar opening on the other side to be retained therein so that the rounded tip of toe 18*d* is poised above the center point of a double-incline bump 16*k* at the bottom of frame 16 as shown in FIG. 6. As shown in FIG. 7, frame 16 also has a pair of lugs 16*m* and 16*n* internally so that the opposite peripheral portions of the bottom end of compression spring 20 abut thereagainst, causing compression of the spring whenever one wing of the pawl is depressed and also causes restoration of the pawl into its upper center position with toe 18*d* poised above the middle point of double-incline bump 16*k* when the pawl is released.

From the foregoing, it will be apparent that when mechanical interlock 6 is assembled onto contactor 2 as hereinbefore descried, wing 18*e* of pawl 18 will initially slide down on projection 8*a*. of the contact carrier 8 and will snap below projection 8*a* into aperture 2*b* at the same time as lugs 16*f* snap into the upper corners of aperture 2*b*. When the other contactor 4 is coupled to the mechanical interlock, the other wing 18*f* of pawl 18 will snap in a similar manner below the projection 8*a'* of the contact carrier of that contactor. Therefore, all that is required to assemble the mechanical interlock onto a pair of contactors is to place its hooks above the upper corners of the contactor and to slide it down until it snaps into place. In this assembly, the corresponding wing of the interlocking pawl will automatically go into its proper position under the projection of the contact carrier. Also, to remove the mechanical interlock from the contactor, it is only necessary to pull the lower portion of the mechanical interlock outwardly, stressing the two hooks, so that the lugs such as 16*e* or 16*f* as the case may be, clear the upper corner surface of aperture 2*b* whereupon the mechanical interlock may be lifted directly upwardly off of the contactor.

The mechanical interlock is also provided with means for preventing dirt or other extraneous matter from falling into frame 16 into the area where pawl 18 must rock. For this purpose, frame 16 has integrally molded thereon a panel 16*p* as shown in FIG. 7 having its lower end free. At the other side of frame 16 a similar panel 16*q* is integrally molded with frame 16 except that it has an integral thin hinge 16*r* at its lower end as shown in FIGS. 4 and 6 and its upper end is initially connected to frame 16 by a narrow, breakable strip 16*s* shown in FIG. 4. After pawl 18 with spring 20 mounted thereon has been inserted into frame 16 and snapped down into its operating position, panel 16*q* is pressed inwardly so as to break strip 16*s* and bend it at its hinge horizontally so that its upper end snaps below the lower end of panel 16*p* as shown in FIG. 6, thus forming a cover over the pocket that retains pawl 18 and preventing at least any large particles of dirt or extraneous matter from falling thereinto.

Figure 9:
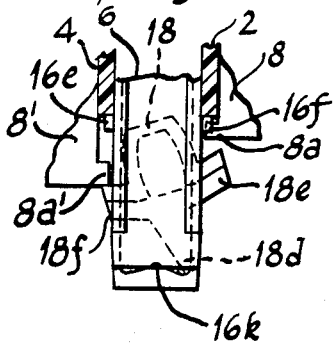
FIG. 9 is a fragmentary cross-sectional view of the two contactors of FIG. 1 showing the lower portion of the interlock therebetween with the pawl in operative position.

When one of the contactors such as 4 is actuated as shown in FIG. 9, its contact carrier 8' moves down carrying with it projection 8*a'* that presses down on wing 18*f* of pawl 18. This causes pawl 18 to rock within frame 16 and to move down, compressing spring 20, so that its toe 18*d* slides down one of the inclines of double-incline bump 16*k* and stops in the pocket at the lower end of such incline after the contacts close as shown in FIG. 9. As a result, pawl 18 becomes rigidly fixed within frame 16 and the other wing 18*e* of pawl 18 remains in or near contact with the like projection 8*a* on the contact carrier 8 of the other contactor 2 so that the other contactor cannot be operated at the same time. When the operated contactor is restored to normal position, its contact carrier including projection 8*a'* moves back upwardly to the position shown in FIG. 3, releasing pawl 18. As a result, spring 20 restores pawl 18 to its normal position shown in FIG. 6 with its toe 18*d* poised over the center point of double-incline bump 16*k*.

While the apparatus hereinbefore described is effectively adapted to fulfill the objects stated, it is to be understood that the invention is not intended to be confined to the particular preferred embodiment of mechanical interlock for contactors disclosed, inasmuch as it is susceptible of various modifications without departing from the scope of the appended claims.

We claim:

1. In an electrical switching system having a pair of electrical switching devices mounted adjacent one another in predetermined spaced apart relation and each said switching device having a housing with a flat wall and an aperture in said flat wall and a switch actuating member within said housing having a projection extending substantially into the plane of said flat wall and being accessible through said aperture, and the flat walls of said switching devices facing one another, means for interlocking said switch actuating members for operation one at a time comprising:

false-front upper left and right corners on each said flat wall;

a generally T-shaped integrally molded frame comprising symmetrical opposite sides in juxtaposition with said flat walls of said switching devices, and each said side having at the opposite ends of its upper arms a pair of hooks defining vertical slides for gripping and sliding down the outer edges of said false-front upper left and right corners, and a lug at an intermediate point on said side of said frame that snaps into said aperture to rigidly snap-in mount said frame onto and between said pair of electrical switching devices;

the lower portion of said frame having therewithin a pair of lateral pockets with a double-incline bump therebetween;

a pair of openings on respectively opposite lateral sides of said frame;

and a spring-biased pawl movably confined within said frame and having a pair of opposite wings extending through said openings below said projections of said switch actuating members of said pair of switching devices and a toe at its lower end poised above said double-inclined bump such that when one of said switch actuating members is operated, it depresses the corresponding wing to rock said pawl thereby causing said toe to slide down the opposite incline of said bump into the corresponding pocket to stop said pawl so that the other wing thereof restrains the other switch actuating member from being operated.

2. The electrical switching system claimed in claim 1, wherein:

said frame is provided with an integrally molded panel on one side above said pawl having a lower free end and an integrally molded panel on the other side above said pawl having an integral hinge at its lower end so that when it is bent inwardly and snapped below said free end, it provides a cover which prevents dirt or extraneous matter from falling around said pawl and interfering with its operation.

3. The electrical switching system claimed in claim 1, wherein:

said frame is provided with holes on opposite sides thereof with one of said holes being large enough for insertion of said pawl within said frame and the other of said holes being large enough to receive the corresponding wing of said pawl;

and said frame having snap-down slots extending from said holes to the corresponding openings for cooperation with said wings for snap-in assembly of said pawl into said frame.

4. The electrical switching system claimed in claim 1, wherein:

said spring-biased pawl comprises a molded member having a vertically elongated hole therethrough with lugs at the top and bottom thereof, and an helical compression spring in said hole with its opposite ends retained on said lugs and said toe of said pawl being thin enough so that the opposite peripheral portions of the lower end of said spring extend beyond the sides thereof;

and said frame comprises a pair of abutments on opposite sides of said toe for engaging the lower end of and compressing said spring when one of said wings is depressed by the corresponding switch actuating member so as to restore said pawl when released.

5. The electrical switching system claimed in claim 1, wherein:

each said wing comprises an upper surface that extends outwardly at a small upward angle to maintain solid engagement with said projection of said switch actuating member throughout its stroke as said pawl is rocked thereby.

* * * * *